US006749095B2

(12) United States Patent
Johnson

(10) Patent No.: US 6,749,095 B2
(45) Date of Patent: Jun. 15, 2004

(54) NOTEBOOK BINDER CARRIER STRAP

(76) Inventor: Eric Johnson, 141 Church Rd., Medford, NJ (US) 08055

( * ) Notice: Subject to any disclaimer, the term of this patent is extended or adjusted under 35 U.S.C. 154(b) by 0 days.

(21) Appl. No.: 10/107,463

(22) Filed: Mar. 26, 2002

(65) Prior Publication Data

US 2002/0139823 A1 Oct. 3, 2002

Related U.S. Application Data

(60) Provisional application No. 60/279,514, filed on Mar. 28, 2001.

(51) Int. Cl.[7] ..... A45F 3/14
(52) U.S. Cl. ..... 224/250; 224/257
(58) Field of Search ..... 224/250, 257; 294/138, 152, 136, 149, 150; 281/42; 402/4

(56) References Cited

U.S. PATENT DOCUMENTS

| | | | | | |
|---|---|---|---|---|---|
| 313,021 | A | * | 2/1885 | Pott, Jr. et al. | 294/152 |
| 518,034 | A | * | 4/1894 | Hoyle | 294/152 |
| 665,256 | A | * | 1/1901 | McComb | 294/152 |
| 726,119 | A | * | 4/1903 | Trognitz | 294/152 |
| 745,251 | A | * | 11/1903 | Sleght | 204/152 |
| 1,082,017 | A | * | 12/1913 | Feinen | 294/152 |
| 1,136,598 | A | * | 4/1915 | Gould | 294/152 |
| 1,411,175 | A | * | 3/1922 | Maguire | 295/149 |
| 1,492,677 | A | * | 5/1924 | Dunbar et al. | 150/106 |
| 3,268,134 | A | * | 8/1966 | Baston et al. | 224/55 |
| 3,933,287 | A | * | 1/1976 | Foley | 224/55 |
| 4,036,417 | A | * | 7/1977 | Traphagan | 224/45 N |
| 4,487,443 | A | * | 12/1984 | Adamick | 294/151 |
| 4,958,759 | A | * | 9/1990 | Jarvis | 224/151 |
| 5,251,945 | A | * | 10/1993 | Stoops | 294/152 |
| 5,405,010 | A | * | 4/1995 | Goldberger | 281/42 X |
| 5,409,282 | A | * | 4/1995 | Bale | 294/152 |
| 5,456,497 | A | * | 10/1995 | Ross, Jr. | 281/42 |
| 5,769,477 | A | * | 6/1998 | Lehrer | 294/138 |
| 5,863,088 | A | * | 1/1999 | Kelly, Sr. et al. | 294/146 |
| D417,889 | S | * | 12/1999 | French | D19/26 |
| 6,109,678 | A | * | 8/2000 | Esfandiari et al. | 294/152 |

* cited by examiner

*Primary Examiner*—Sue A. Weaver
(74) *Attorney, Agent, or Firm*—Donald C. Simpson

(57) ABSTRACT

A strap that can be wrapped around a notebook binder at right angles to its spine and separably attaches to the notebook binder and wraps around the notebook and overlaps itself and separably attaches to itself, and preferably, in its closed position, has carrying means as an integral part of the strap.

8 Claims, 9 Drawing Sheets

NOTEBOOK BINDER CARRIER STRAP

PRIOR APPLICATIONS

This patent application is based on and incorporates in its entirety by reference Provisional Patent Application 60/279,514, filed Mar. 28, 2001, the benefit of which filing date is claimed.

This invention relates to a belt or strap for notebook binders which can be separably attached to a notebook binder in a manner such as to permit the easy carrying thereof.

BACKGROUND OF THE INVENTION

It has become a common practice for students at all education levels to use large binders for storing and transporting assignments, homework, and other papers which they wish to transport between home and school. Typically, these notebook binders are of a size to accommodate and enclose paper measuring 8½ inches by 11 inches, and frequently are between three to four inches thick so as to permit the storage of papers from all of the student's classes in a single notebook. Such notebooks are bulky, difficult to carry, difficult to store in a locker, and are easily dropped during the normal transportation of the notebook between home and school.

It is, of course, common for persons carrying such bulky notebooks to transport them in briefcases, attache cases, backpacks or the like, all of which, however, contribute to the weight and bulk of the materials to be carried and to the storage problems when the notebook is in use. U.S. Pat. Nos. 4,487,443 (Adamick) and 4,958,759 (Jarvis) and the references cited therein illustrate some of the attempts that have been made to deal with the aforementioned problems, but these inventions lack the simplicity of design that permit easy use by the student and a low cost of construction by the manufacturer.

SUMMARY OF THE INVENTION

The present invention comprises a strap that can be wrapped around a notebook binder at right angles to its spine, which strap separably attaches to the notebook binder and wraps around the notebook and overlaps itself and separably attaches to itself. In its closed position, the notebook binder carrier strap additionally has carrying means as an integral part of the strap.

DETAILED DESCRIPTION OF THE INVENTION

The terms "exterior" and "interior" are used hereinafter with regard to the notebook binder strap relative to its position when used with a notebook binder.

Figure 1:
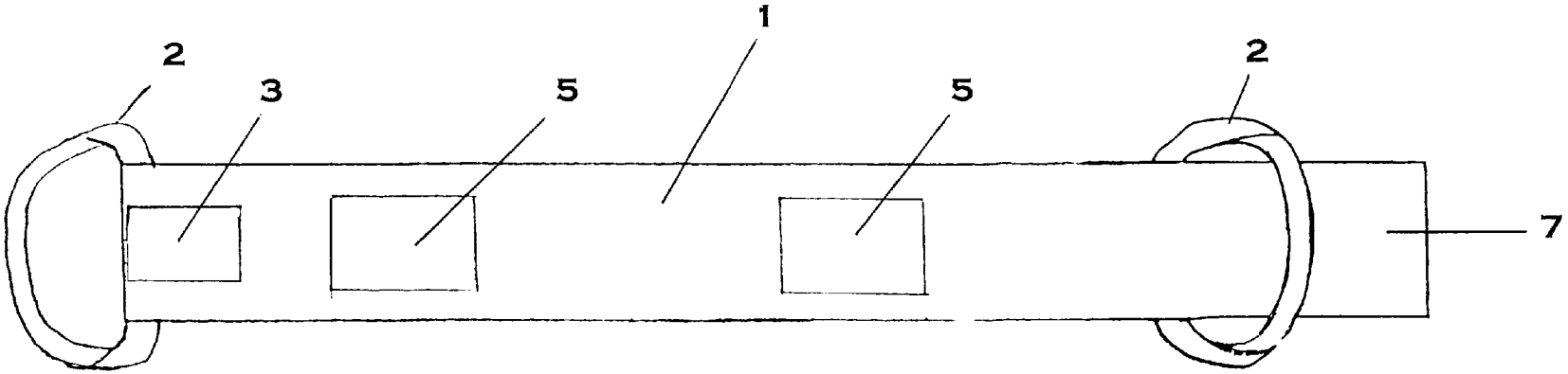
FIGS. 1A and 1B show, respectively, the normally exterior and the normally interior sides of the notebook binder carrier strap of the present invention.
Figure 1:
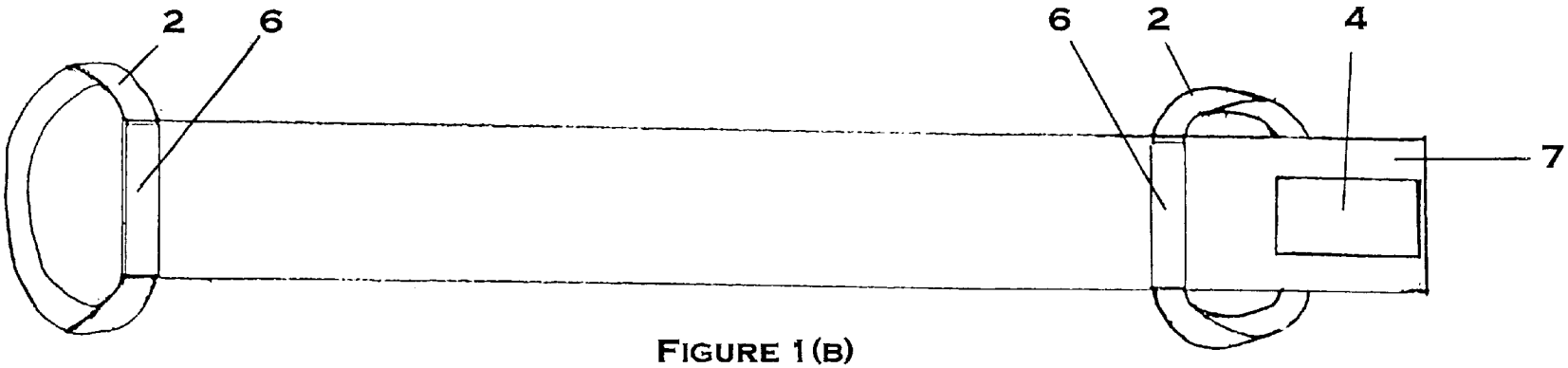
Figure 2:
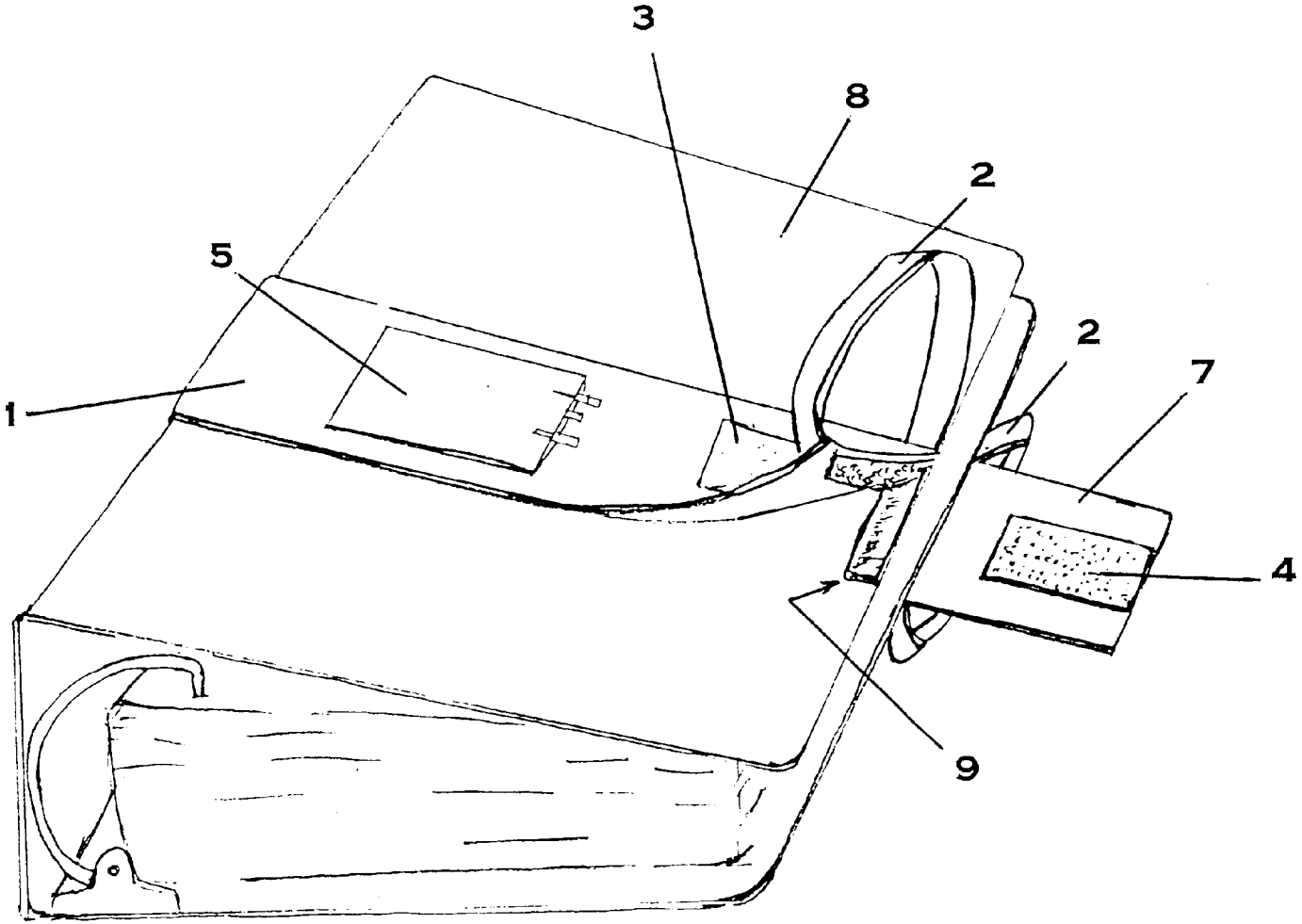
FIG. 2 illustrates the notebook binder carrier strap of the present invention partially wrapped around a typical three ring notebook.
Figure 3:
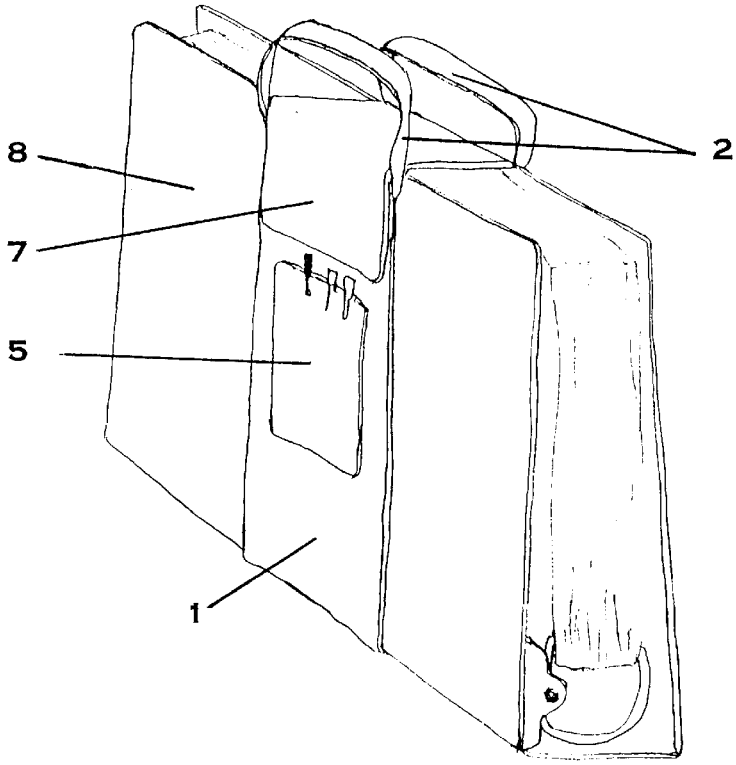
FIG. 3 illustrates the notebook binder carrier strap completely enclosing a notebook ready for the notebook to be carried by the strap handles.
Figure 4:
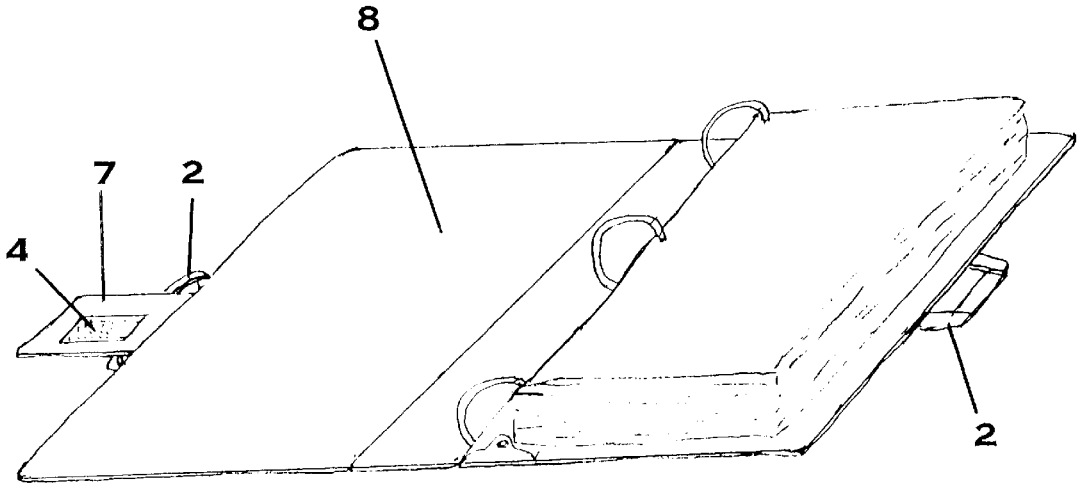
FIG. 4 illustrates the notebook binder carrier strap with both the notebook and the strap in open position.

In FIGS. 1A, 2, 3, 5A and 5B, the exterior side of the notebook carrier binder strap is shown and in FIGS. 1B and 4, the interior side of the notebook carrier binder strap is shown.

With reference specifically to FIGS. 1A and 1B, the invention consists of a strap 1 which may be made of any suitable strapping material having sufficient flexibility to wrap around a notebook such as heavy cloth, rubber, nylon, leather, or the like. The strap is provided with a pair of matching strap handles 2 which are fixed to the strap by sewing or bonding or any other suitable means capable of supporting the notebook carrier binder strap with its intended contents. One of said strap handles is affixed in close proximity to one end of strap 1; that end of the strap will be referred to hereinafter as the "first attaching end" with reference to the condition of that end when the strap is in normal use and to distinguish it from the second or "closure" end 7. The second strap handle is positioned a short distance from the "closure end" of the strap and is positioned along said strap a distance from said first strap handle approximately equal to the perimeter of a closed notebook binder intended to be carried by said strap. In this way, the two strap handles will be in effective alignment with each other for carrying purposes when the notebook binder strap is in place around the notebook, as illustrated in FIG. 3.

The end of the strap extending beyond the second strap handle as referred to above serves as the closure end of the strap 7 and will be so designated hereinafter. The notebook carrier binder strap 1 is provided with a first separable fastener means 3, and a second separable fastener means 4. First separable fastener means 3 is provided on the external side of the notebook carrier binder strap in close proximity to the first of said strap handles, and the second separable fastener means 4 is positioned on the interior side of said notebook carrier binder strap on the interior side of the strap and on the strap closure end of the strap 7. The separable fastener means may be any of the typical hook and loop fasteners (e.g. "Velcro"; see U.S. Pat. Nos. 2,717,437 and 3,009,235), snap fasteners, or even an easily releasable adhesive (such as the type found on products such as "Post-its"). In the case of fasteners such as hook and loop type or the snap type, it is necessary that separable fastener means 3 and 4 be mating. In the case of an easily releasable adhesive, it is necessary that one of the surfaces be affixed with the adhesive and the other surface only needs to be capable of being releasably adhered to the adhesive.

The interior side of the notebook carrier binder strap is provided with one or more fastening means for releasably attaching the notebook binder carrier strap to the notebook binder cover with which the strap is intended to be used. In general, two of such fastening means 6 are preferred. As shown in the illustrations, fastening means 6 are conveniently positioned at approximately the same location as the attachment points of straps 2. These fastening means can consist of essentially the same kind of materials that are used for separable fasteners 3 and 4 provided the notebook carrier binder with which the strap is going to be used is provided with the necessary mating component. The hook and loop materials and the snap materials are available on a substrait that can have an adhesive applied to the underside for attachment to such things as, in this case, the notebook binder cover.

As is shown in FIGS. 1A, 2 and 3, the notebook binder strap can optionally be provided with pockets 5 for holding pencils and other small items, but such pockets 5 are not essential to the practice of the present invention.

FIG. 2 illustrates schematically the placement of the notebook carrier binder strap of the present invention around a typical notebook. The strap has been wrapped generally around a notebook. The notebook has been provided with a releasable fastening means 9 which is the mate to fastening means 6 so that the strap can be releasably attached to the notebook. Typically, these fastening means 9 comprise a releasable attaching means on the opposite sides of the notebook which will contact and mate with fastening means 6 at the inner surface of strap 1.

Figure 6B:
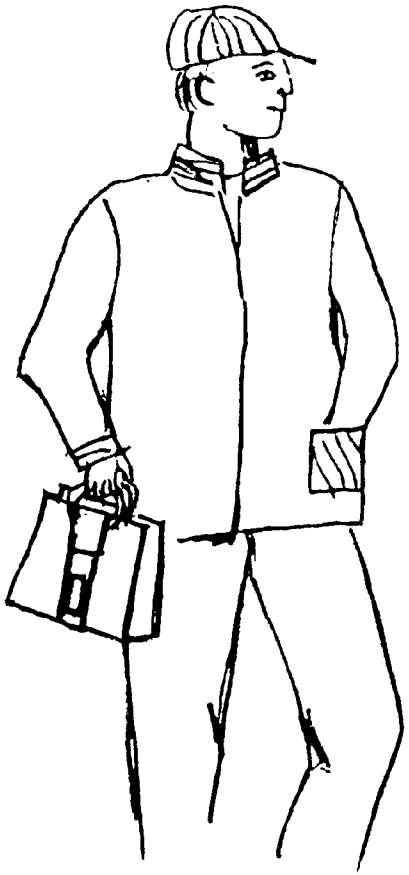
FIGS. 6A and 6B illustrate, respectively, the use of the notebook binder strap with and without a shoulder strap.

With reference to FIGS. 2 and 3, the closure end 7 of strap 1 is inserted through the first strap handle to overlap the first end of notebook carrier binder strap 1 and to bring releasable attaching means 3 and 4 into attaching contact with each other to effectively form a closed loop around notebook 8 and help to hold it in place. In this process, the strap handles 2 are brought into alignment with each other as shown generally in FIG. 3, permitting the user to carry the notebook and strap combination as shown in FIG. 6B.

Figure 5A:
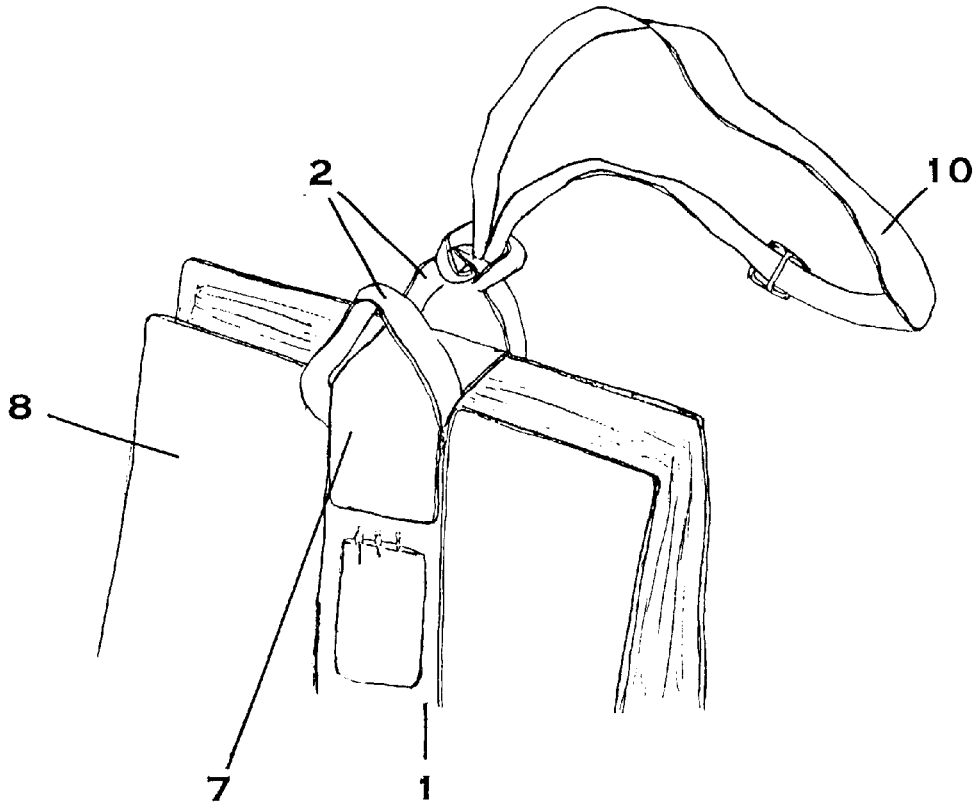
FIGS. 5A and 5B illustrate the attachment of a carrier strap to the notebook binder strap it handles.
Figure 5B:
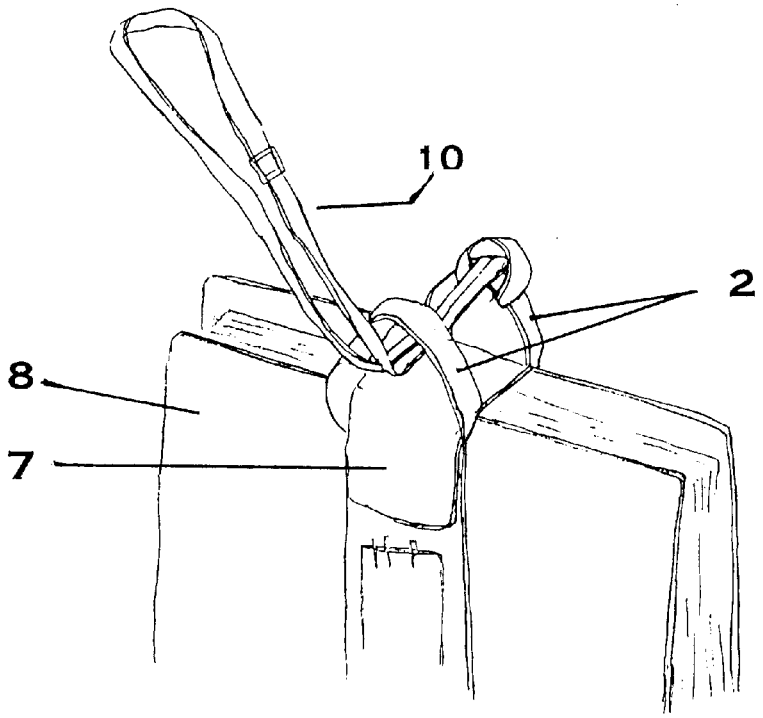
Figure 6A:
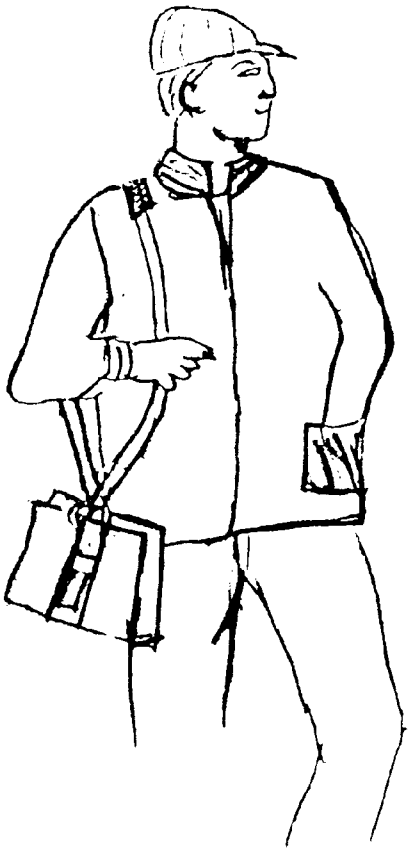

Once the two strap handles are in alignment with each other, it is then possible to connect a shoulder strap such as loop 10, shown in FIGS. 5A and 5B, to one of the strap handles 2 as shown in FIG. 5A and pass it through the second strap handle, as shown in FIG. 5B, thereby providing a shoulder strap for use as shown in FIG. 6A.

Figure 7A:
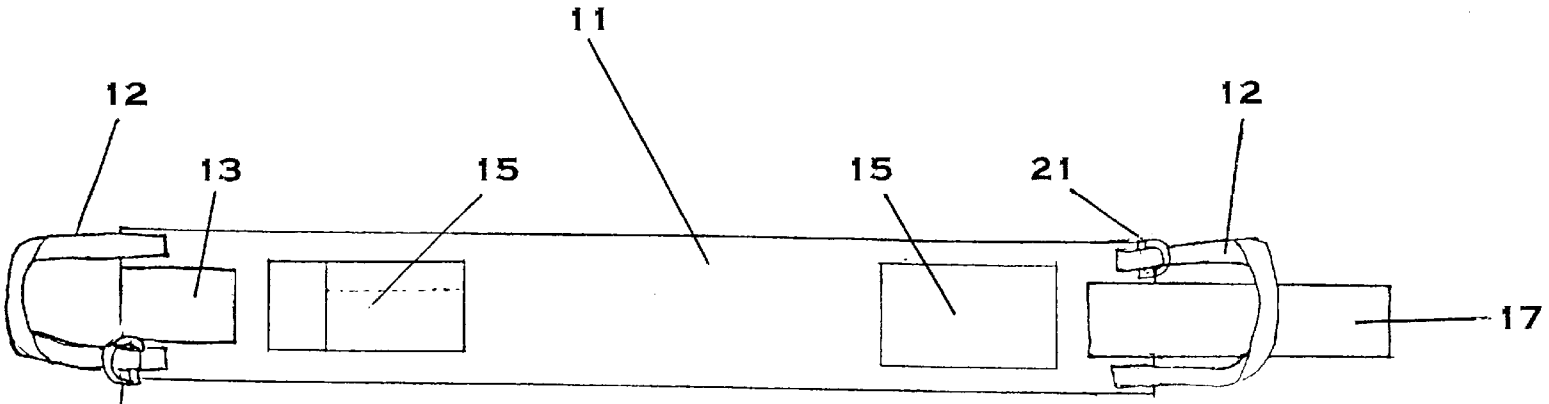
FIGS. 7A and 7B show, respectively, the normally exterior and the normally interior sides of the notebook binder carrier strap of the present invention.
Figure 7B:
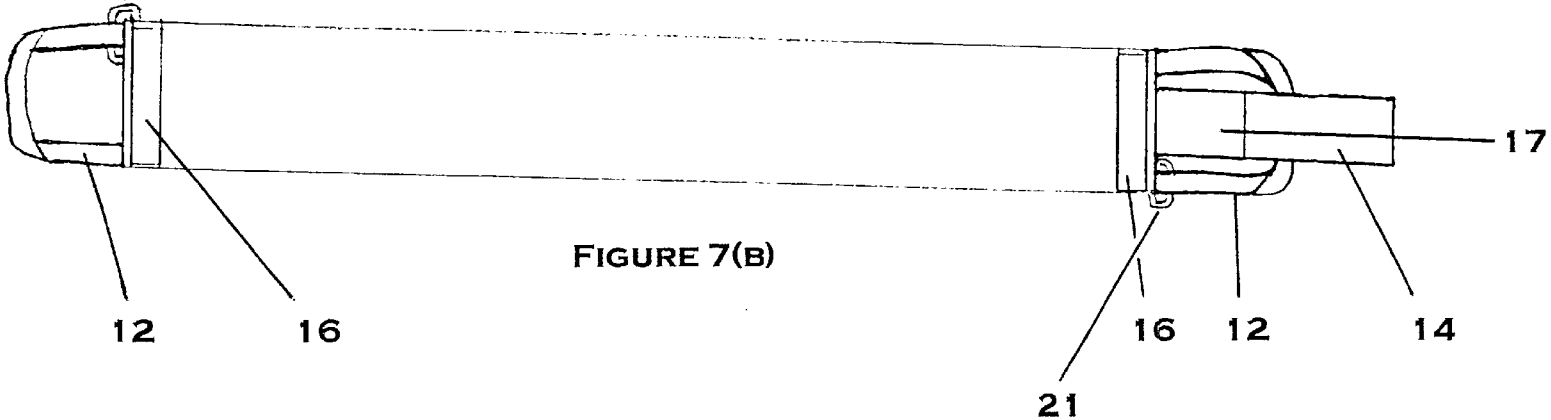
Figure 8:
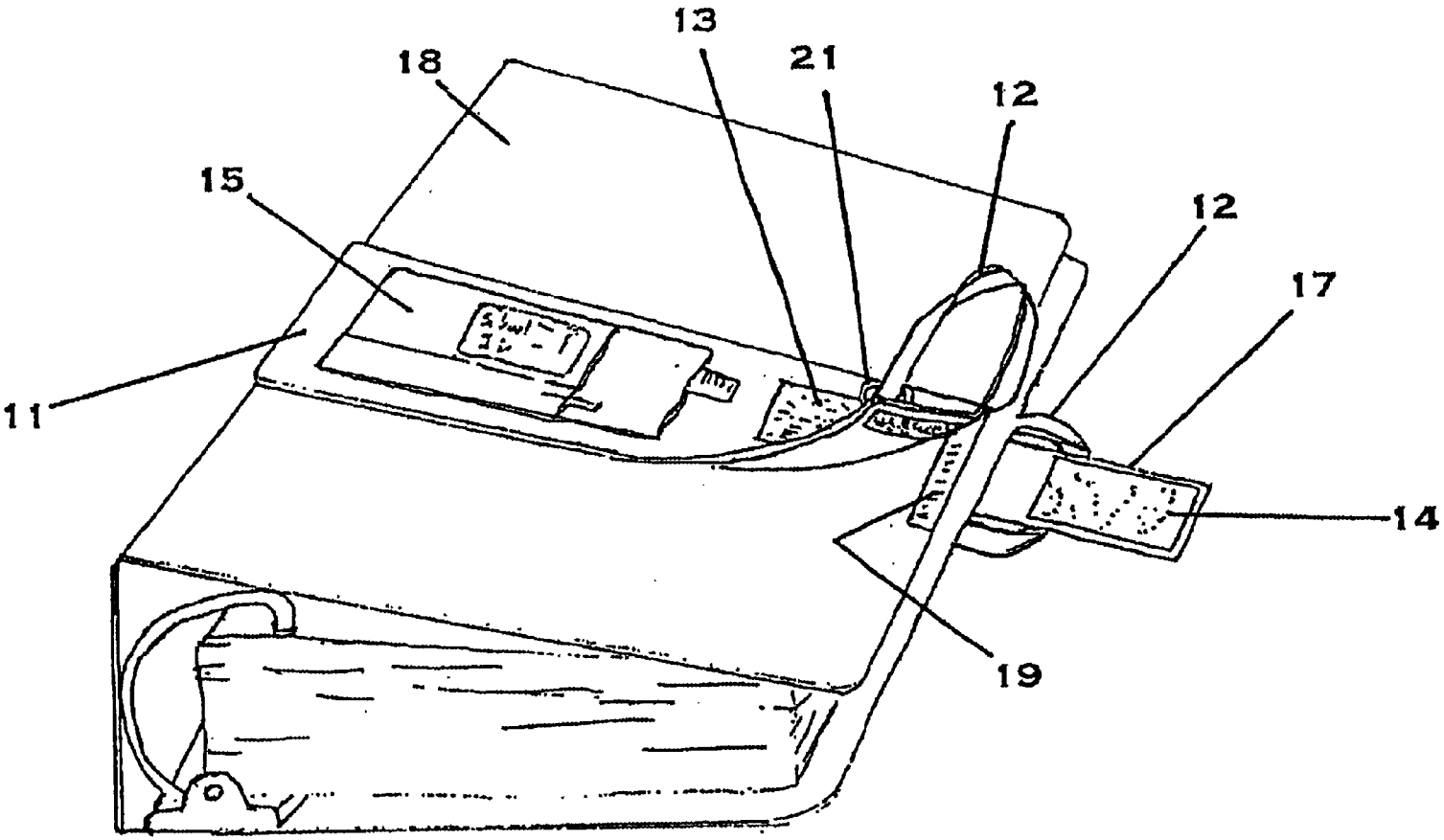
FIG. 8 illustrates the notebook binder carrier strap of FIGS. 7A and 7B partially wrapped around a typical three ring notebook.
Figure 9:
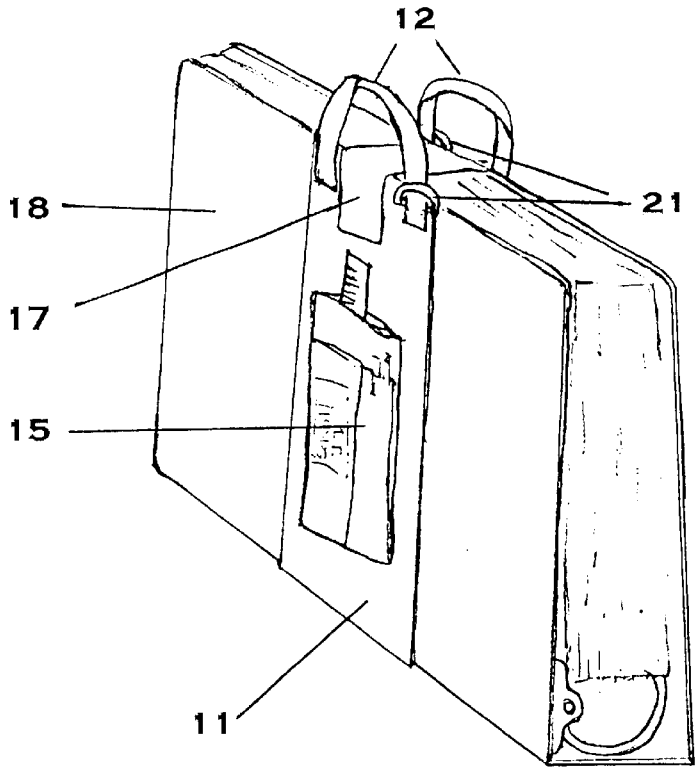
FIG. 9 illustrates the notebook binder carrier strap of FIGS. 7A and 7B completely enclosing a notebook ready for the notebook to be carried by the strap handles.
Figure 10:
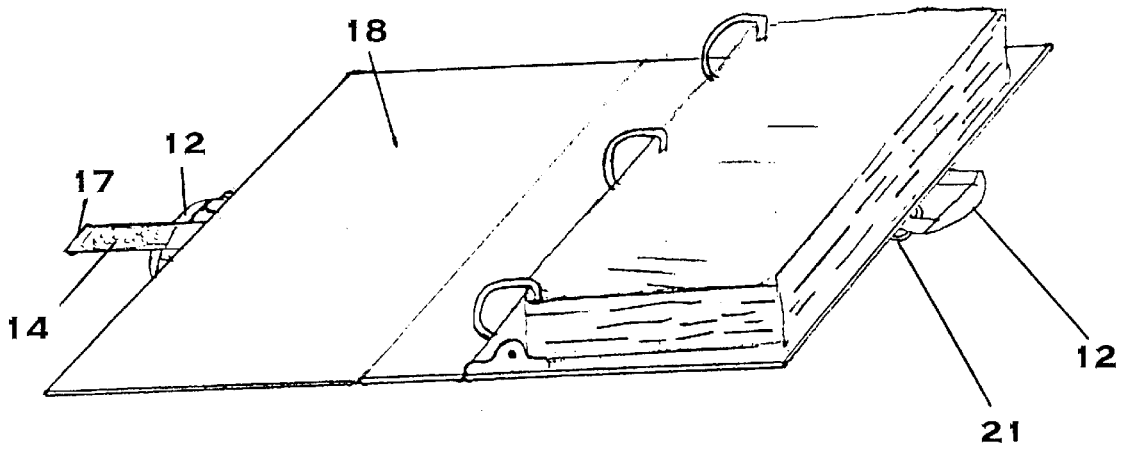
FIG. 10 illustrates the notebook binder carrier strap of FIGS. 7A and 7B with both the notebook and the strap in open position.
Figure 11:
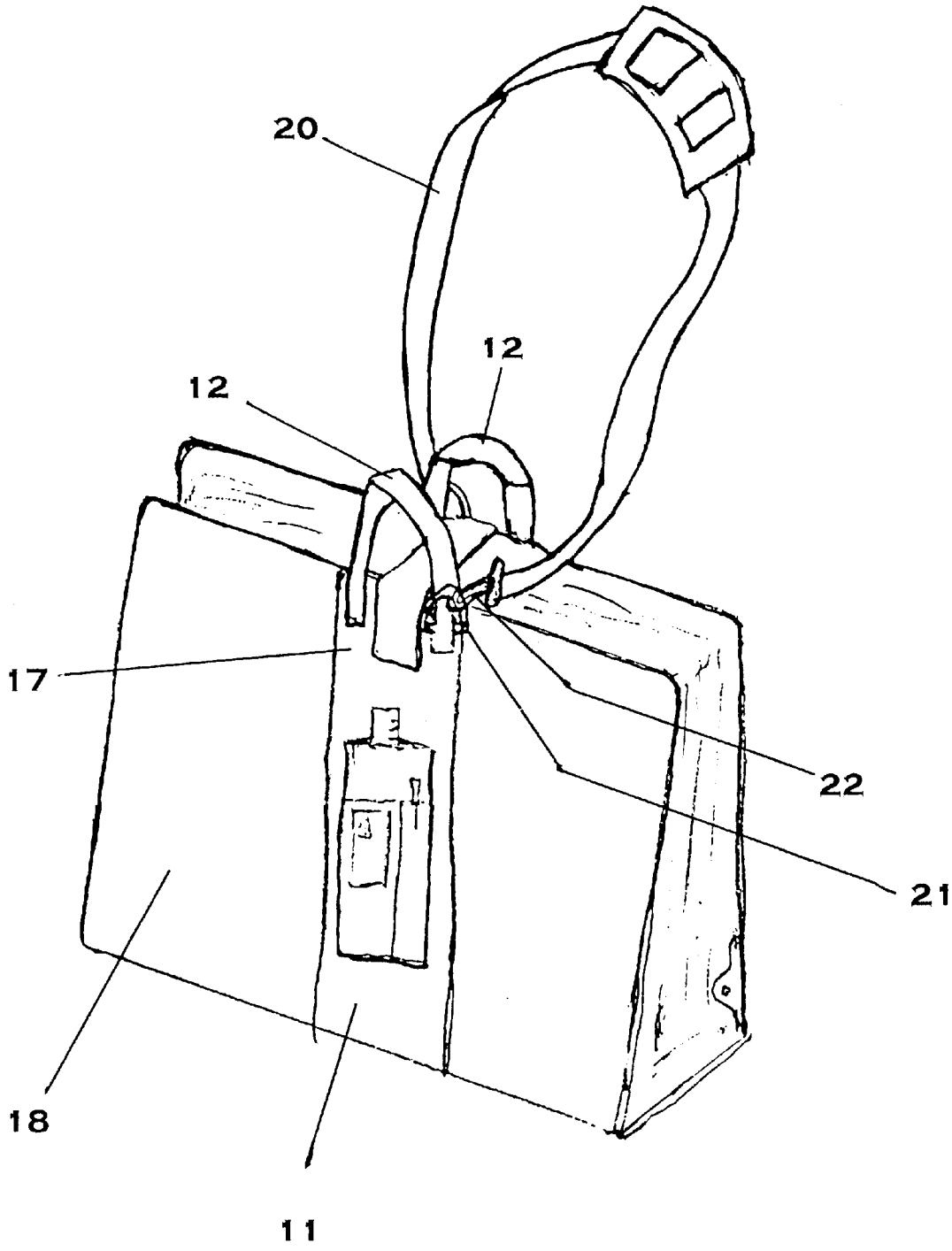
FIG. 11 illustrates the attachment of a carrier strap to the handles of the notebook binder strap of FIGS. 7A and 7B.

In FIGS. 7A, 8, 9, and 11, the exterior side of the notebook carrier binder strap is shown and in FIGS. 7B and 10, the interior side of the notebook carrier binder strap is shown.

With reference specifically to FIGS. 7A and 7B, the invention consists of a strap 11 which may be made of any suitable strapping material having sufficient flexibility to wrap around a notebook such as heavy cloth, rubber, nylon, leather, or the like. The strap is provided with a pair of matching strap handles 12 which are fixed to the strap by sewing or bonding or any other suitable means capable of supporting the notebook carrier binder strap with its intended contents. One of said strap handles is affixed in close proximity to one end of strap 11; that end of the strap will be referred to hereinafter as the "first attaching end" with reference to the condition of that end when the strap is in normal use and to distinguish it from the second or "closure" end 17. The second strap handle is positioned a short distance from the "closure end" of the strap and is positioned along said strap a distance from said first strap handle approximately equal to the perimeter of a closed notebook binder intended to be carried by said strap. In this way, the two strap handles will be in effective alignment with each other for carrying purposes when the notebook binder strap is in place around the notebook, as illustrated in FIG. 9.

One of the differences between the embodiment of FIGS. 1A and 1B and the embodiment of FIGS. 7A and 7B involves the manner in which the strap handles are attached to the body of the strap. In the former embodiment, the handles are wrapped around the strap and the handle ends are attached to the interior side of the strap. In the latter embodiment, each handle is placed in a generally "horseshoe" configuration and the ends of each handle are fastened to the strap near the edges of the exterior side of the strap. In this manner, the amount of material between the body of the strap and the contained notebook is minimized and the carrying of the strap-notebook combination as shown in FIG. 9 provides an enhanced inward pressure to hold the notebook closed during transport.

A second distinguishing feature between the embodiment of FIGS. 1A and 1B and the embodiment of FIGS. 7A and 7B is found by examination of the closure ends, 7 and 17 respectively, of the two embodiments. In the former embodiment, the closure end is merely an extension of the body of strap 1. In the latter embodiment, the body of strap 11 terminates in close proximity to the closure end handle and a "tongue" is attached to the strap in a manner such that it extend from the strap 11 through handle 12 sufficient length to permit closure of the strap around a notebook.

The notebook carrier binder strap 11 is provided with a first separable fastener means 13, and a second separable fastener means 14. First separable fastener means 13 is provided on the external side of the notebook carrier binder strap in close proximity to the first of said strap handles, and the second separable fastener means 14 is positioned on the interior side of said notebook carrier binder strap on the strap "tongue", i.e., closure end 17.

The interior side of the notebook carrier binder strap is provided with one or more fastening means 16 for releasably attaching the notebook binder carrier strap to the notebook binder cover with which the strap is intended to be used. In general, two of such fastening means 16 are preferred. As shown in the illustrations, fastening means 16 are conveniently positioned at approximately the same location as the attachment points of straps 12. These fastening means can consist of essentially the same kind of materials that are used for separable fasteners 13 and 14 provided the notebook carrier binder with which the strap is going to be used is provided with the necessary mating component. As in the case of the first embodiment, the hook and loop materials and the snap materials are available on a substrate that can have an adhesive applied to the underside for attachment to such things as, in this case, the notebook binder cover.

As is shown in FIGS. 7A, 8 and 9, the notebook binder strap can optionally be provided with pockets 15 for holding pencils and other small items, but such pockets 15 are not essential to the practice of the present invention.

FIG. 8 illustrates schematically the placement of the notebook carrier binder strap of the present invention around a typical notebook. The strap has been wrapped generally around a notebook. The notebook has been provided with a releasable fastening means 19 which is the mate to fastening means 16 so that the strap can be releasably attached to the notebook. Typically, these fastening means 19 comprise a releasable attaching means on the opposite sides of the notebook which will contact and mate with fastening means 16 at the inner surface of strap 11.

With reference to FIGS. 8 and 9, the closure end 17 of strap 11 is inserted through the first strap handle to overlap the first end of notebook carrier binder strap 11 and to bring releasable attaching means 13 and 14 into attaching contact with each other to effectively form a closed loop around notebook 18 and help to hold it in place. In this process, the strap handles 12 are brought into alignment with each other as shown generally in FIG. 9, permitting the user to carry the notebook and strap combination as shown in FIG. 6B.

Once the two strap handles are in alignment with each other, it is then possible to connect a shoulder strap such as loop 20. This illustrates a further variation between the embodiments. Instead of using a loop as the shoulder strap and attaching it to the strap handles as shown in FIGS. 5A and B, the strap handles are fitted with rings and the shoulder strap can be a simple strap with appropriate hooks 22 at the end for attaching to the rings. In the preferred embodiment, the rings are D-rings 21 that can be sewn to strap 11 with the attachment of the handles 12. In general, it is preferable to have to D-rings at diagonally opposite corners of the main body of strap 11.

The main body of the strap should be at least three inches wide; if the strap is any narrower, it will not adequately hold a notebook without risk of tilting and possibly spilling the contents. The strap should not be wider than about six inches or it becomes unduly bulky which defeats the objective of having a light-weight carrier. A width of about four inches has been found to be quite satisfactory and is preferred. The basic strap length should approximate twice the width of the notebook cover plus the width of the notebook spine with which it is to be used. In the case where the basic strap is going to wrap around over itself and fasten, the base strap should have an additional length equal to the spine width plus an additional three to four inches of overlap. In the case where the strap has a tongue at one end for wrapping and overlapping, the tongue should be equal in length to the "additional length" just defined plus sufficient additional length to permit fastening of the tongue to the base strap. The tongue should, of course, be narrower than the base strap in order to permit attachment of the handles and any D-rings on either side of the tongue attachment.

From the foregoing, it can be seen that the present invention can readily carry out all of the objects and attain the ends and advantages mentioned. While the preferred embodiments of the invention have been provided for purposes of disclosure, numerous changes in the details of construction, materials used, and the interconnection and arrangements of parts will readily suggest themselves to those skilled in the art and are encompassed within the spirit of the invention. While the invention is described with particular reference to a notebook binder, it is to be understood that the invention resides in the overall strap which can equally well be used with notebook-like objects which have covers, page contents, and the same general type of "clam shell" closure, e.g., file folders, books, and the like.

What is claimed is:

1. A carrier strap for carrying a looseleaf notebook-type binder comprising a flat strap having a width in the range of about three (3) inches up to a maximum of six (6) incehes and having a first end and a second end and an intervening length sufficient to wrap completely around said binder and to overlap itself; a first loop handle affixed to said flat strap at said first end; a second loop handle affixed to said flat strap at a point between said first end and said second end a distance along said flat strap from the attachment of said first handle equal to approximately the sum of twice the width of the cover of the aforementioned binder and the width of the binder spine; the portion of said flat strap between said loop handles being substantially uniform in width, said first and second ends provided with readily separable attachment means located on the adjacent sides of the portion of the carrier strap that overlap when said carrier strap is wrapped about the aforementioned looseleaf notebook-type binder, and at least one readily separable attachment means affixed to the surface of said carrier strap that will abut the surface of said binder when said binder is wrapped by said carrier strap and adapted to releasably attach said carrier strap to said binder during use.

2. A carrier strap in accordance with claim 1 wherein the surface of said strap that will be the exterior surface in normal use is provided with at least one pocket affixed thereto.

3. A carrier strap in accordance with claim 1 additionally provided with a shoulder strap adapted to be releasably attached to said carrier strap proximate to said handles.

4. A carrier strap in accordance with claim 1 and said carrier strap comprises a first, wider portion of a length approximately equal to the distance between said first and second handles, and a second, narrower portion fixed to said other portion proximate said second handle, and of sufficient length to constitute the said overlapping second strap end.

5. A carrier strap in accordance with claim 4 wherein the surface of said carrier strap that will be the exterior surface in normal use is provided with at least one pocket affixed thereto.

6. A carrier strap in accordance with claim 4 additionally provided with a shoulder strap adapted to be releasably attached to said carrier strap proximate to said handles.

7. A carrier strap in accordance with claim 6 wherein said loop handles are formed from fabric strips configured in a generally U-shape with the ends of the U affixed to said wider strap portion on either side of the attachment of the narrower strap portion.

8. A carrier strap in accordance with claim 7 wherein said shoulder strap constitutes a strip of fabric having a releasable attachment means on each end thereof and a ring attachment for said shoulder strap affixed to said carrier strap proximate to each handle.

* * * * *